US006128843A

United States Patent [19]

Gebka

[11] Patent Number: 6,128,843

[45] Date of Patent: Oct. 10, 2000

[54] UNIVERSAL TWO-PIECE LABEL HOLDER SYSTEM FOR HOOKS

[75] Inventor: John Gebka, Coral Springs, Fla.

[73] Assignee: Fast Industries, Ltd., Fort Lauderdale, Fla.

[21] Appl. No.: 09/271,361

[22] Filed: Mar. 17, 1999

[51] Int. Cl.[7] ..... G09F 3/00; B42F 3/00

[52] U.S. Cl. ..... 40/642.01; 40/666; 248/222.11; 211/57.1; 24/339

[58] Field of Search ..... 40/299.01, 642.01, 40/657, 658, 666; 248/220.31, 220.41, 222.11; 24/205, 336, 339; 211/57.1, 59.1

[56] References Cited

U.S. PATENT DOCUMENTS

| | | | |
|---|---|---|---|
| 4,194,637 | 3/1980 | Edson | 211/59.1 X |
| 4,525,944 | 7/1985 | Fast . | |
| 4,593,824 | 6/1986 | Pfeiter | 40/642.01 X |
| 4,646,454 | 3/1987 | Fast . | |
| 4,665,639 | 5/1987 | Fast . | |
| 4,693,024 | 9/1987 | Fast . | |
| 4,693,441 | 9/1987 | Conway | 248/220.41 |
| 4,698,929 | 10/1987 | Fast . | |
| 4,699,278 | 10/1987 | Klein | 211/57.1 |
| 4,703,570 | 11/1987 | Fast . | |
| 4,715,135 | 12/1987 | Fast . | |
| 4,754,563 | 7/1988 | Fast . | |
| 4,934,080 | 6/1990 | Karnes et al. . | |
| 5,027,478 | 7/1991 | Suhr | 24/339 X |
| 5,261,175 | 11/1993 | Gebka . | |
| 5,703,330 | 12/1997 | Kujawski | 24/339 X |

*Primary Examiner*—Brian K. Green
*Attorney, Agent, or Firm*—Jacobson, Price, Holman & Stern, PLLC

[57] ABSTRACT

A universal two-piece label holder system for hooks of various sizes and configurations, including single and double rod or U-shaped loop hooks, comprises a versatile ring-shaped saddle having a plurality of peripherally spaced clasps of different dimensions, at least one of which will grippingly engage a single rod hook, with an adjacent clasp slidingly engaging the second rod of a double rod or loop hook at a selected position along the length of the hook. An elongated plastic tag or overlay, preferably having a label holder at its distal end, is adapted to overlie the hook, with side edge portions of the tag engaged by flanges on the saddle and a selected one of a plurality of spaced openings along the intermediate portion of the tag engaged over a projection on the saddle to thereby limit movement of the tag relative to the saddle both laterally and longitudinally and to arcuately flex the tag to rigidify the same. The saddle may be positioned at any desired location along the length of the hook to thereby limit the portion of the hook available to receive and suspend products to the portion forwardly of the saddle whereby the saddle functions as an inventory control device.

27 Claims, 4 Drawing Sheets

UNIVERSAL TWO-PIECE LABEL HOLDER SYSTEM FOR HOOKS

This invention relates to product identification and information tags for merchandise suspended from horizontally extending product support hooks, and relates more particularly to a universal two-piece label holder system comprising an elongated, preferably die-cut, plastic tag having a label holder at its distal end, and a versatile saddle having a plurality of clasps of different dimensions adapted to grippingly engage single or double-rod hooks of varying gauge at a selected position along their lengths to rigidly support the tag in spaced relationship to the hook, limiting the lateral and longitudinal movement of the tag relative to the saddle, and simultaneously functioning as an inventory control device.

BACKGROUND OF THE INVENTION

Forwardly extending product information tags adapted to overlie elongated product support hooks to provide a display portion or label holder to provide product identification and information forwardly of the distal end of the hook are well know. Such hooks commonly have a proximal end adapted to be attached to a support surface such as an apertured board, a wire grid or the like, an elongated rod-like intermediate portion projecting substantially horizontally from the support surface for carrying products, and a free distal end for receipt and removal of the products suspended on the hook. There are many different forms of such hooks, several styles being illustratively shown, for example, in Fast U.S. Pat. No. 4,525,944 issued Jul. 2, 1985 (the Fast '944 patent), Fast U.S. Pat. No. 4,646,454 issued Mar. 3, 1987 (the Fast '454 patent), Fast U.S. Pat. No. 4,665,639 issued May 19, 1987 (the Fast '639 patent), Fast U.S. Pat. No. 4,693,024 issued Sep. 15, 1987 (the Fast '024 patent), Fast U.S. Pat. No. 4,698,929 issued Oct. 13, 1987 (the Fast '929 patent), Fast U.S. Pat. No. 4,703,570 issued Nov. 3, 1987 (the Fast '570 patent), Fast U.S. Pat. No. 4,715,135 issued Dec. 29, 1987 (the Fast '135 patent), Fast U.S. Pat. No. 4,754,563 issued Jul. 5, 1988 (the Fast '563 patent), and Gebka U.S. Pat. No. 5,261,175 issued Nov. 16, 1993 (the Gebka patent), the subject matter of each of which is incorporated herein in its entirety by reference. Commonly, such hooks have a single elongated merchandise support rod, the distal end of which may be passed through apertures formed in the cards of blister-packed or other such products. Alternatively, the hook may comprise a pair of laterally spaced rods or it may be formed by a U-shaped loop of plastic or metal. While the two rods of a double rod may be used to individually support apertured products, they commonly are designed to together receive products with elongated slots defined therein, much like the U-shaped loop.

The rod or rods forming the merchandise support hook may have any desired cross-section, but generally are circular in cross-section and may be formed of wire or other such material of different gauges and varying length.

Depending on the type of support, the proximal end of such hooks may take various forms. For example, the mounting means may include a pair of spaced, horizontally extending arms which project through two openings in an apertured board, and are bent upwardly behind the board so as to retain the bracket and support hook in place. With a single rod, the mounting arms may be carried by a cross-bar or be formed as apart of a mounting plate to which the proximal end of the support hook is secured. In the case of the double-looped hook, the proximal end of the pair of rods may include generally upwardly extending arms or sections adapted to be engaged in juxtaposed openings of an apertured board or the like.

As mentioned, while elongated hooks of the type described are commonly carried by apertured boards, oftentimes such hooks are adapted to be affixed to a different type of support surface, such as elongated rods, grids, angle irons, plates or racks. Over the years, various adaptations of forwardly extending product information tags have been developed for use with such different forms of elongated hooks. Exemplary of such products are those shown in the aforementioned Fast and Gebka patents, and others.

For the most part, forwardly extending product information display tags of the type described have been adapted to be supported in one form or another at their proximal end at the point where the proximal end of the hook is secured to a support surface. Thus, as will be seen from the referenced patents, it has been necessary heretofore to provide individualized mounting means on the proximal end ofthe forwardly extending information tag, depending upon the type of hook used, the support surface for the hook and the mechanism by which the hook is secured to the support surface. Considering the variety of applications, this is obviously an expensive and inconvenient solution, retailers preferring to minimize the number of styles of label holders necessary to accommodate the wide variety of hooks in use.

The one thing common to substantially all such hook arrangements is at least one forwardly extending elongated rod adapted to carry products. In Karnes et al U.S. Pat. No. 4,934,080 issued Jun. 19, 1990 (the Karnes et al patent), support for the proximal end of the forwardly extending elongated tag is provided by a separate element in the form of a saddle member slidably and removably mounted on the elongated rod-like intermediate portion of the hook, generally adjacent the proximal end of the hook The Karnes et al saddle can have a single clasp for mounting the same on a hook with a single rod, or a pair of spaced clasps for mounting the same on a double rod or loop hook.

The Karnes et al saddle member defines a generally horizontally extending support surface with upstanding projections adapted to be frictionally engaged in complementary apertures defined in the tag. The use of such a saddle member enables the elongated forwardly extending product information tag to be readily secured to a hook, without removing the hook from its engagement with an apertured board or other such support member. Moreover, with the saddle member carried by the forwardly extending rod-like portion of the hook, the mounting portion of the tag is not dependent upon the manner in which the support hook is engaged with an apertured board or other such support member. Thus, the design of the tag can be more universal.

While the Karnes et al saddle system minimizes the varieties of tag constructions necessary to accommodate different mounting systems and forms of hooks, the Karnes et al saddle is designed either for use with a single rod hook or a double rod or U-shaped loop hook and a single Karnes et al saddle construction is not adapted for use with different types of hooks. Additionally, Karnes et al either require different forms of saddle to accommodate different gauges of rods used in the merchandise support hooks, or complicated mechanisms, including set screws and the like, to adjust the clasps used to mount the saddle on the hook.

Moreover, since the forwardly extending merchandise information tags or overlays themselves are generally formed of relatively thin sheets of plastic material, they are not particularly rigid. Thus, when such tags are supported from their proximal end on a Kames et al-type saddle a relatively long segment of the plastic tag is cantilevered forwardly of the saddle which may result in a sagging of the intermediate or forward portion of the tag in use. At the very least, support of the distal end of the tag on the distal end of the hook is necessary to limit sagging under the weight of the label holder. With the tag supported on the front of the hook, it is necessary to lift the tag in order to add or remove product from the free end of the hook. Although not necessary for commercial application, it would obviously be desirable to provide a mechanism where the elongated immediate portion of the tag can be rigidified, minimize sagging, and even enabling the forward end of the tag to be retained in spaced relationship to the distal end of the hook thus making it easier to add product to the hook, or remove product from the hook. The Karnes et al system is not well suited to accomplish the foregoing.

Finally, retailers desire a system that will selectively reduce the overall length of usable space on a hook to thereby prevent clerks from overstocking which tends to reduce profitability. Thus, with a saddle-type system, it would be desirable to be able to position the saddle member at any desired location along the length of the hook to function as an inventory control, that is, to limit the portion of the hook on which products may be suspended by the interposition of the saddle, thereby ensuring that merchandise is retained on the forward portion of the hook, limiting overstocking and making product more readily available to the consumer. While Karnes et al recognize the desirability of positioning their saddle member at different locations along the length of the hook, since their system fails to rigidify the tag, support of the tag is less than satisfactory even if a complicated cover system proposed by Karnes et al is utilized.

Thus, while Karnes et al have reduced the varieties of tags necessary to accommodate different hooks and mounting systems, the Karnes et al system still requires a multiplicity of individualized or complicated saddle constructions, limiting the cost effectiveness of the Karnes et al concepts and reducing the commercial appeal of this system.

SUMMARY OF THE INVENTION

It is primary object of the instant invention to provide a universal two-piece label holder system for use with single or double rod hooks of differing gauge. Consistent therewith, the preferred embodiments of this invention provide a saddle having at least three clasps spaced from each other on a single base member, the clasps being of different dimensions adapted to grippingly engage hooks of different gauge.

A further object of this invention is the provision of a ring-like saddle having clasps of different dimension spaced about its periphery to accommodate single or double hooks of differing gauge, with support surfaces between juxtaposed clasps adapted to underlie and support the intermediate portion of a forwardly extending elongate product information tag in spaced relationship to the hook. In the preferred embodiments of this invention, tag-engaging elements extend outwardly from the supporting surfaces on such a universal saddle member to limit the movement of a supported tag relative to the saddle. The tag-engaging elements may include a pair of upstanding inverted L-shaped flange members, one on each side of each supporting surface, thereby defining opposed pockets adapted to slidingly receive the side edges of the tag to limit the transverse or lateral movement of the tag relative to the saddle. Additionally, the tag-engaging elements preferably include an upstanding projection on each supporting surface adapted to be frictionally engaged in one of a plurality of longitudinally spaced openings formed in the tag to thereby limit the longitudinal movement of the tag relative to the saddle.

Another object of this invention is to provide a ring-like saddle member for use in combination with a longitudinally extending product information tag wherein the supporting surfaces are convexly curved whereby, when the intermediate portion of the tag is secured to a supporting surface by the tag-engaging elements, the tag is arcuately flexed to stiffen the tag and thereby strengthen and rigidify the tag to preclude portions of the tag spaced from the cantilever support provided by the saddle from sagging in use. With such a construction, the saddle may be positioned at substantially any location along the length of the hook to shorten or lengthen the portion of the hook available to receive and suspend products to that portion forwardly of the saddle, thereby additionally functioning as an inventory control mechanism.

These and other objects, features and many of the attendant advantages of the invention will be better understood upon consideration of the following detailed description of the preferred embodiments, taken in conjunction with the accompanying drawings.

BRIEF DESCRIPTION OF THE DRAWINGS

Like reference characters refer to like parts throughout the several view of the drawings.

DETAILED DESCRIPTION OF THE PREFERRED EMBODIMENTS

Figure 3:
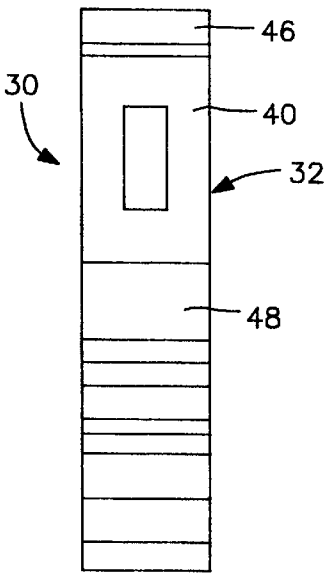
FIG. 3 is a side elevational view thereof.

In describing the preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 6:
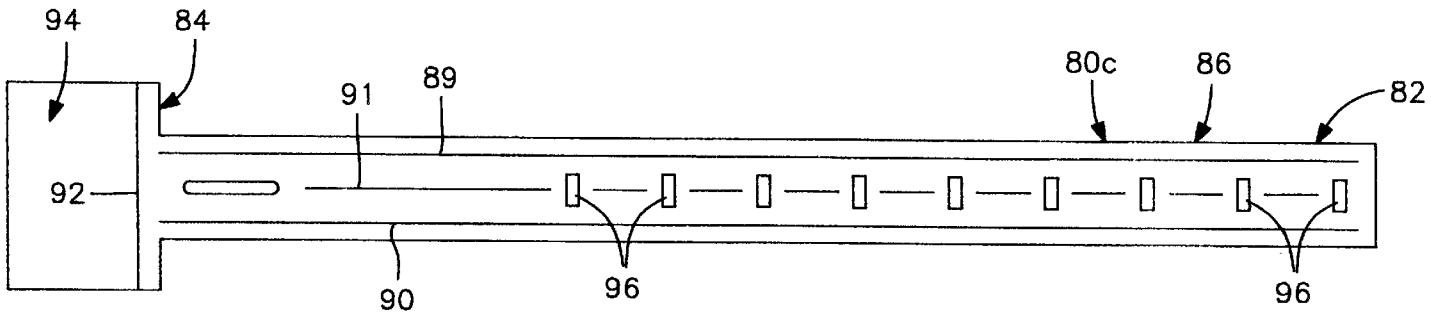
Figure 7:
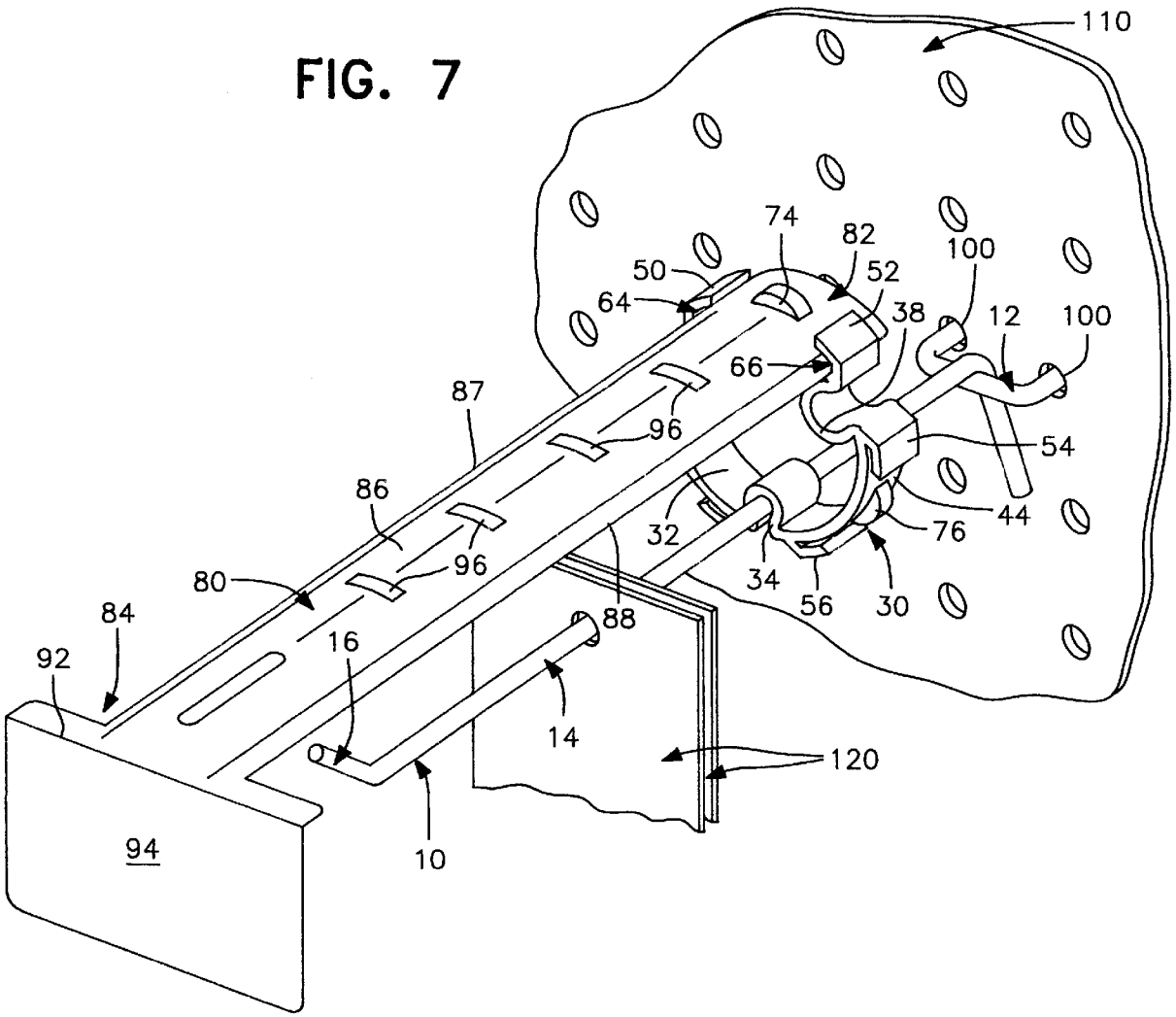
FIG. 7 illustrates the use of the preferred saddle and tag construction with a single rod hook.
Figure 8:
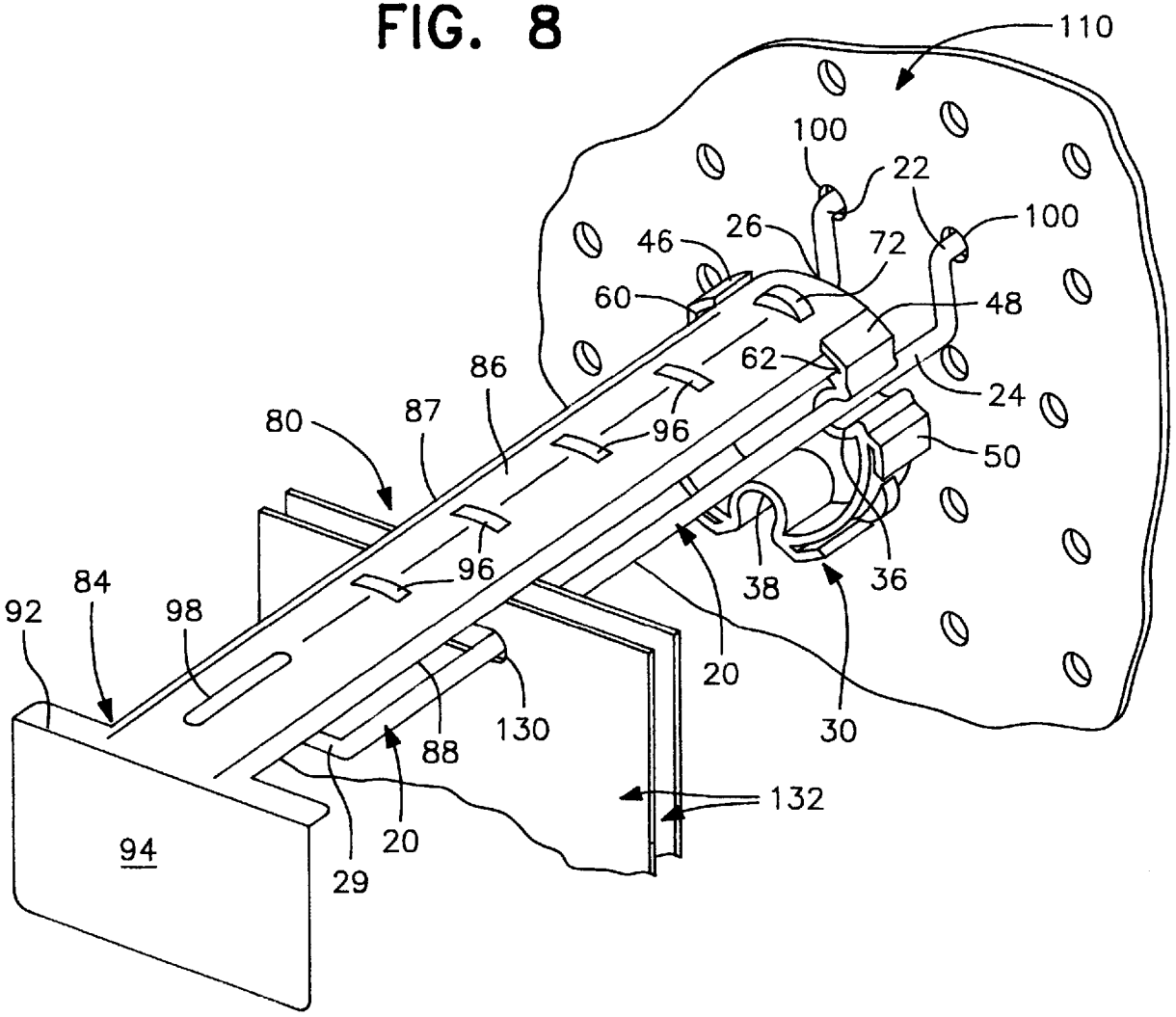
FIG. 8 illustrates the use of the preferred saddle and tag construction with a double rod U-shaped loop hook.

Reference is initially made to FIGS. 7 and 8 wherein the universal two-piece label holder system of the preferred universal two-piece label holder system of the instant invention is illustrated in use with a single rod hook 10 in FIG. 7 and a double rod U-shaped loop hook 20 in FIG. 8. In each instance, the elements of the instant invention are identical, namely, namely the universal ring-like saddle 30, shown more particularly in FIGS. 1–3, and the elongated product identification and information tag 80, several embodiments of which are shown in more detail in FIGS. 4–6.

Figure 1:
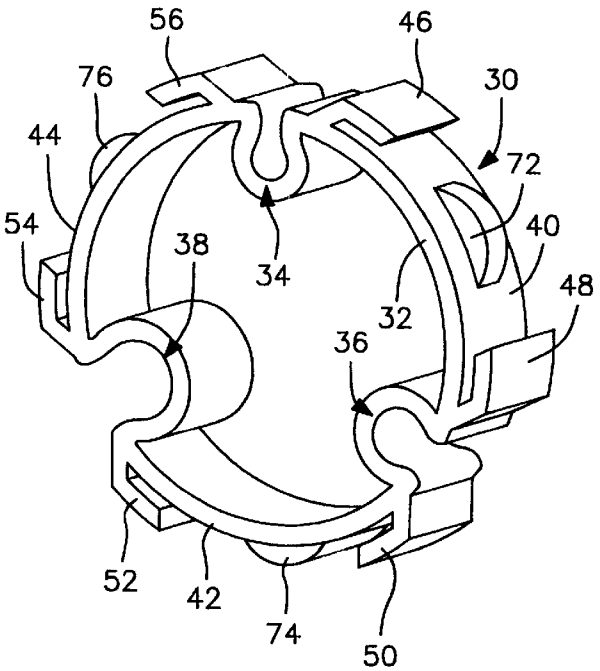
FIG. 1 is a perspective view of a preferred universal saddle member according to the instant inventive concepts.

The saddle is, preferably, molded in the form shown in FIG. 1, comprising a ring-like base member 32 with at least three clasps 34, 36, 38 defined by inwardly extending, U-shaped gripping elements, spaced about the ring 32. As will be seen in the drawings, clasps 34, 36, 38 are of different dimensions, and are designed to grippingly engage the intermediate portions or elongated rods of hooks of different gauge material. The specific dimensions of the individual clasps can be varied, but having three separate clasps enables the saddle 30 to accommodate the sizes of substantially all rods commonly in use in commercially available merchandise support systems.

Three equally spaced clasps as shown in the drawings are particularly convenient. Yet, it is to be understood that more than three clasps can be provided on a single saddle if greater versatility is necessary.

It is also to be understood that, while the saddle 30 is shown as having a generally circular base member 32, those skilled in the art will recognize that the specific configuration of the base member can be modified without departing from the instant inventive concepts. However, the arcuate or curvilinear nature of the base member 32 provides significant advantages in flexing and rigidifying the tag 80 in a manner to be described in more detail hereinafter.

It is to be noted that the opening or mouth of each clasp 32, 36, 38 is somewhat constricted. The saddle 30 can be formed of various materials, the preferred material being moldable, relatively rigid, polyvinyl chloride, with a durometer that would prevent slippage of the saddle 30 when affixed on a hook. It is desirable, however, for the material of the base member 32 to have some resiliency so that the individual clasps can be slightly flexed in use to snap over the rod of a hook to grippingly engage the same in a secure manner.

In between juxtaposed clasps 34 and 36, 36 and 38 and 38 and 34, arcuate tag-supporting surfaces 40, 42 and 44, respectively, are formed by the base member 32. Each supporting surface is provided with outwardly extending tag-engaging elements adapted to limit the movement of a tag 80 relative to the saddle 30. Specifically, two separate tag-engaging elements, which best function in combination with each other, are shown in the drawings. First, upstanding flange members 46 and 48, 50 and 52 and 54 and 56 are provided on opposite sides of each of the supporting surfaces 40, 42 and 44, respectively. The pair of flange members associated with each of the supporting surfaces comprise individual flanges which are generally of inverted L-shape and include an upwardly extending leg and an inwardly extending leg, the latter being spaced from its respective supporting surface to thereby define opposed pockets 58 and 60, 62 and 64 and 66 and 68 adapted to slidingly receive and retain the side edges of a tag as discussed below, to thereby limit the transverse or lateral movement of a tag relative to the saddle 30.

In addition to the flange elements adapted to limit lateral movement of a tag relative to the saddle 30, each supporting surface is provided with at least one upstanding projection as illustrated at 72, 74 and 76, respectively. The projections are adapted to frictionally engage in selected openings formed in the tag 80 as described below to thereby limit the longitudinal movement of the tag 80 relative to the saddle 30.

As shown in the preferred embodiments of the drawings, only a single projection is provided on each supporting surface, although, obviously, a pair of spaced projections may be used, if desired. Additionally, the projections are illustrated as arcuate in nature and transversely elongated. Such a construction has been found most effective in easily securing a tag to the saddle 30 at a selected position along the length of a hook. Moreover, the transversely elongated projections function effectively in cooperation with the flange members, to bow or arcuately flex the tag to stiffen the same in use.

Figure 2:
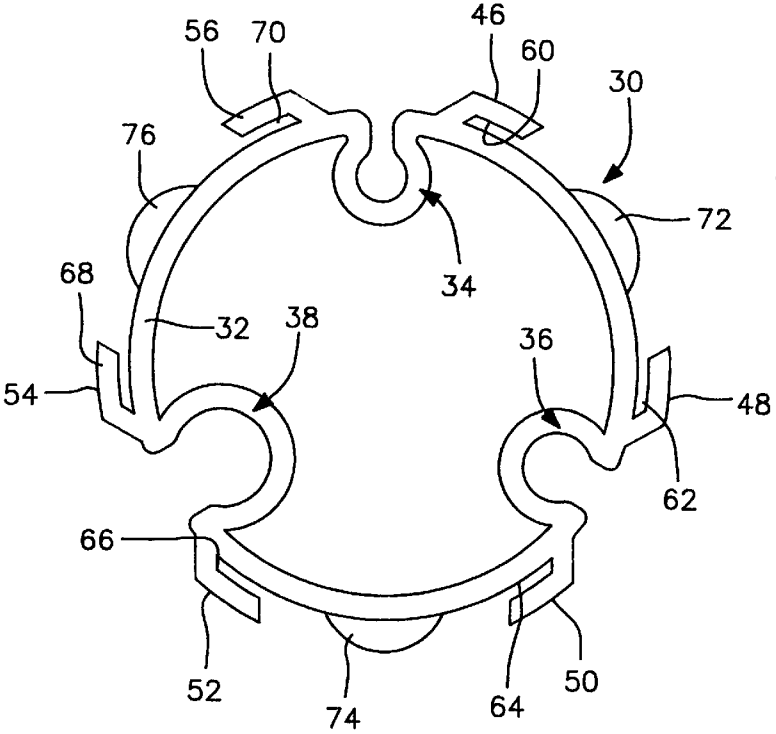
FIG. 2 is a front elevational view thereof.
Figure 4:
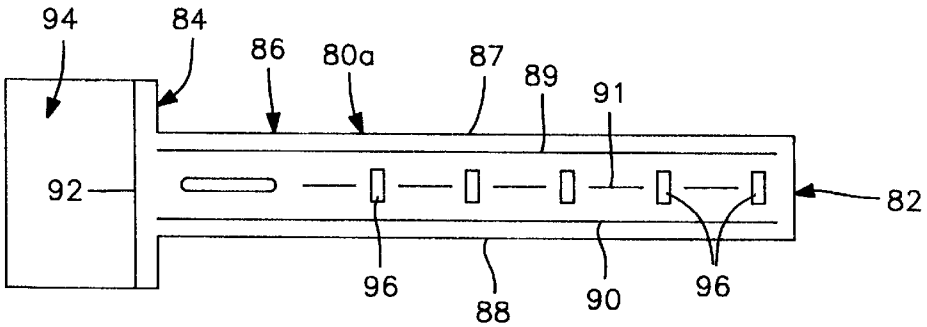
FIGS. 4–6 are plan views of different length product information tags that can be effectively used with the saddle of FIGS. 1–3.
Figure 5:
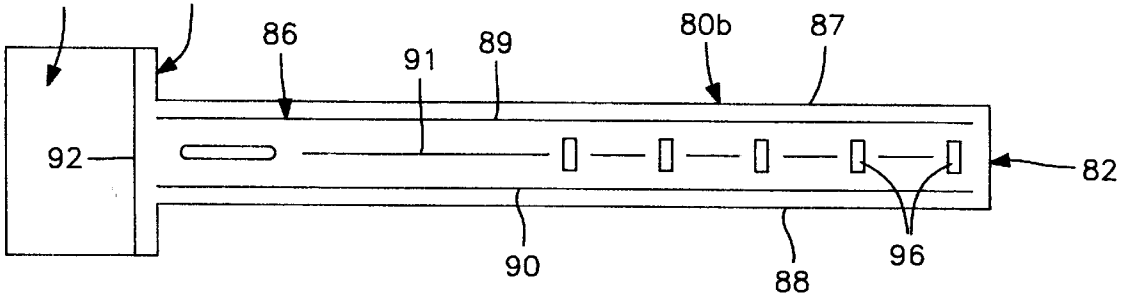

Referring now to FIGS. 4–6, three different length product information tags or overlays that can be effectively used with a saddle such as illustrated at 30 in FIGS. 1–3 are designated generally by the reference numerals 80*a*, 80*b* and 80*c*, respectively. For all intents and purposes, the tags are substantially identical, except for their length which is varied to accommodate standard single or double rod hooks which are also provided in different lengths. The tags are generally die-cut and may be formed of polyvinyl chloride sheet or other acceptable material as is common in this industry.

Although three different lengths of tag 80 are shown for illustrative purposes, the particular dimensions of the tag are not critical to the instant inventive concepts and selection of appropriate lengths for commercial applications is well within the ordinary skill of the art. Obviously, if desired, a tag such as shown at 80*c* in FIG. 6 may simply be cut to a length, if desired. Moreover, in lieu of a multiplicity of different length tags 80, an adjustable length tag may be provided as disclosed in my copending application Ser. No. 09/046,509 filed Mar. 24, 1998, the subject matter of which is incorporated herein by reference. With such a construction, a single length tag may be provided with a series of longitudinally spaced alternating fold and tear lines spaced midway between adjacent apertures so that the tag may be folded onto itself to align adjacent apertures, transversely torn, or even transversely torn and then folded on itself to provide the tag with different effective lengths.

In any event, each tag 80 comprises a proximal end 82 to be positioned toward a support surface for the hook as described below, a distal end 84, and an elongate intermediate portion 86 extending from the proximal end to the distal end adapted to overlie the intermediate portion of the hook. The intermediate portion 86 has opposed side edge portions 87 and 88 and may include reinforcing ribs 89, 90, 91 to strengthen the same.

At the distal end 84 of the tag 80, a transverse fold line 92 may be provided to facilitate bending a panel 94 to a right angular or depending relationship to function as a label holder for displaying identification and/or information regarding products suspended on an underlying hook. Although the label holder panel 94 is shown as planar and is adapted to receive an adhesive label (not shown) in a well known fashion, a replaceable label holder panel such as shown in the Fast '454 patent, or a pocket for reception of a paper label such as shown in the Fast '570 patent, may be substituted therefor. Other obvious modifications to the tag construction may be made without departing from the instant inventive concepts.

A plurality of longitudinally spaced, transversely elongated openings 96 are provided along the intermediate portion 86 of the tag 80, each of which is dimensioned to be frictionally received over a projection 72, 74 or 76 on the saddle 30 to selectively position and limit the longitudinal movement of the tag relative to the saddle 30 in a manner to be discussed further below.

The use of the universal two-piece label holder system of this invention may be best understood with reference to FIGS. 7 and 8. Referring first to FIG. 7, one form of standard single rod product support hook 10 is shown as having upwardly bent mounting prongs 12 engaged in spaced openings 100 of a support surface in the nature of a conventional apertured board 110. The intermediate rod-like portion 14 of the hook 10 projects substantially horizontally from the support surface and has an upwardly bent free distal end 16 to receive and retain products shown illustratively at 120 in a well known manner.

To assemble the label holder on a single rod hook 10, the clasp on the saddle 30 which is dimensioned to grippingly engage the intermediate portion 14 of the hook 10 is selected, illustrated in FIG. 7 as clasp 34, and snapped onto the rod at a selected position along its length. In FIG. 7, the saddle 30 is shown as secured to the hook 10 adjacent the proximal end 12 thereof by the clasp 34. In this position substantially all of the hook 10 is available to receive products 120. If the saddle 30 is moved closer to the distal end 16 of the hook 10, the effective length of the product-receiving portion of the hook 10 is limited for inventory control purposes.

With the clasp 34 snapped onto the hook 10 as seen in FIG. 7, the remainder of the ring 32 sits above the rod 14 and the supporting surface 42 (not seen in FIG. 7) between the clasps 36 and 38 underlies and supports the tag 80. The side edge portions 87 and 88 of the tag 80 are slid into the pockets 64 and 66 defined by the upstanding flanges 50 and 52, respectively on opposite sides of the supporting surface 42 and an appropriate opening 96 defined in the tag 80 is frictionally engaged over projection 74 on the supporting surface 42. Flanges 50, 52 limit lateral movement of the tag 80 relative to the saddle 30 and the engagement of the projection 74 in the opening 96 limits longitudinal movement of the tag 80 relative to the saddle 30.

Additionally, since the supporting surface 42 is curvilinear or arcuate, the intermediate portion of the tag 80, at least in the vicinity of engagement with the saddle 30, is arcuately flexed to thereby stiffen the tag 80. This enables the elongated intermediate portion 86 of the tag 80 to project substantially horizontally in spaced relation to the hook 10 as shown in FIG. 7 to facilitate positioning products 120 over the distal end 16 of the hook 10 or removing products therefrom. If desired, the label holder panel 94 or, for that matter, the entire distal end 84 of the tag 80 may be lifted upwardly to even further increase access to the hook 10.

Although not generally necessary with the universal two-piece label holder system of the instant invention, a longitudinally elongated slot 88 may be provided in the distal end 84 of the tag 80 to receive the distal end 16 of the hook 10, if desired (not shown), to further support and center the tag 80 in overlying relation to the hook 10.

Obviously, with a single rod hook of different gauge wire, a different clasp on the saddle 30 may be selected with the overall system working in substantially the same manner. Further, while the saddle 30 is shown in FIG. 7 as positioned toward the proximal end 12 of the hook 10, it could be moved forwardly with the projection 74 engaged in a different aperture 96 in the tag 80 if it is desired to shorten the portion of the hook 10 available to receive and suspend products for inventory control.

With reference to FIG. 8, use of the universal two-piece label holder system of this invention in association with a double rod or U-shaped loop hook 20 is illustrated. The distal end portions 22 of the two rods 24, 26 of the hook 20 are bent upwardly and engaged in apertures 100 of the apertured board 110 in a conventional manner. The intermediate portions 28 of the double rods project forwardly from the support surface to extend through elongated slots 130 of products 132, the distal end 29 of the hook 20 being bent upwardly to facilitate retaining the products 132 thereon.

With the double rod loop hook 20, a clasp such as clasp 34 (not seen in FIG. 8) may be grippingly engaged with one of the rods 26 of the hook 20 to secure the saddle 30 to the hook with an adjacent clasp 36 being loosely engaged over the other rod 24 of the hook 20. In this arrangement, the remainder of the ring 32 is positioned below the rods 24, 26 with the supporting surface 40 intermediate the clasps 34 and 36 underlying the tag 80. The pockets 60 and 62 defined by the upstanding flanges 46 and 48, respectively, receive the side edges 87 and 88 of the tag 80, with the projection 72 therebetween engaged through a selected opening 96 in the intermediate portion 86 of the tag 80 in a manner similar to that shown in FIG. 7.

Thus, it will be seen that the universal saddle 30 is adapted, not only to grippingly engage wire rods of hooks of three different gauges at any position along their length, but also to function equally as well with a single rod hook or a double rod or looped hook. Moreover, the saddle 30 may be engaged at any position along the length of the single or double rod hook and securely engaged with an appropriate portion of an overlying tag to arcuately flex the tag and limit movement of the tag both laterally and longitudinally with respect to the saddle and the hook. With such an arrangement, for most all applications only a single form of saddle may be kept in inventory. Although different length tags may be provided as illustrated in FIGS. 4–6, if desired an adjustable length tag as disclosed in my aforementioned copending application will even eliminate this redundancy. Thus, a single form of saddle and a single form of tag may effectively suffice for universal application to substantially any hook currently in commercial use thereby avoiding the necessity of maintaining a multiplicity of individualized product identification and information tags or overlays in inventory to accommodate the numerous hook types and dimensions, as well as the diverse mechanisms designed to mount hooks on different support surfaces.

Having described the invention, many modifications thereto will become apparent to those skilled in the art to which it pertains without deviation from the spirit of the invention as defined by the scope of the appended claims.

What is claimed is:

1. In a display device including an elongate hook wherein the hook includes a proximal end to be attached to a support surface, an intermediate portion to project substantially horizontally from the support surface for suspending products thereon, and a free distal end for receipt of the products to be suspended on the hook, a product identification and information tag, and a saddle to support said tag in overlying relation to the hook, the improvement which comprises:

said tag including a proximal end to be positioned toward the support surface, a distal end, and an elongate intermediate portion extending from said proximal end to said distal end for overlying the intermediate portion of the hook, said intermediate portion of said tag including elongate opposed side edges, and said saddle including a base member, at least three clasps spaced from each other on said base member, said clasps being of different dimensions, each from the others, whereby said clasps are adapted to grippingly engage intermediate portions of hooks of different gauges, and supporting surfaces on said base member between each juxtaposed pair of clasps, selected ones of said supporting surfaces being adapted to underlie the intermediate portion of said tag and support said tag in spaced relation to a hook when at least one of said clasps is grippingly engaged with the hook.

2. In the display device of claim 1 wherein said base member is in the form of a generally circular ring, and said clasps are defined by inwardly extending, U-shaped gripping elements, spaced about said ring.

3. In the display device of claim 2, further including tag-engaging elements extending outwardly from each supporting surface adapted to limit movement of said tag relative to said saddle.

4. In the display device of claim 3 wherein said tag-engaging elements include a pair of upstanding flanges on opposite sides of each supporting surface adapted to engage said side edges of said tag seated on said supporting surface and thereby limit lateral movement of said tag relative to said saddle.

5. In the display device of claim 4 wherein each of said flanges includes an upwardly extending leg and an inwardly extending leg spaced from said supporting surface to define opposed pockets adapted to slidingly receive said side edges of said tag.

6. In the display device of claim 3 wherein said intermediate portion of said tag includes a plurality of longitudinally spaced openings, said tag-engaging elements including at least one upstanding projection on each supporting surface adapted to be engaged in selected openings in said tag to thereby limit longitudinal movement of said tag relative to said saddle.

7. In the display device of claim 3 wherein said intermediate portion of said tag includes a plurality of longitudinally spaced openings, said tag-engaging elements including a pair of upstanding flange members on opposite sides of each supporting surface adapted to engage said side edges of said tag seated on said supporting surface to thereby limit lateral movement of said tag relative to said saddle, and at least one upstanding projection on each supporting surface adapted to be engaged in selected openings in said tag to thereby limit longitudinal movement of said tag relative to said saddle.

8. In the display device of claim 7 wherein each of said flanges includes an upwardly extending leg and an inwardly extending leg spaced from its respective supporting surface to define opposed pockets adapted to slidingly receive said side edges of said tag.

9. In the display device of claim 8 wherein said supporting surfaces are generally convexly curved whereby said intermediate portion of said tag is arcuately flexed to stiffen said tag in use.

10. In combination, an elongate hook, a product identification and information tag, and a saddle supporting said tag in overlying relation to said hook, said hook comprising a proximal end adapted to be attached to a support surface, an intermediate portion projecting substantially horizontally from the support surface for suspending products thereon, and a free distal end for receipt of the products to be suspended on said hook, said tag comprising a proximal end adapted to be positioned toward the support surface, a distal end, and an elongate intermediate portion extending from said proximal end to said distal end and overlying said intermediate portion of said hook, said intermediate portion of said tag including elongate opposed side edges, said saddle comprising a base member, at least three clasps spaced from each other on said base member, said clasps being of different dimensions, each from the others, at least one of said clasps grippingly engaging said intermediate portion of said hook, and supporting series on said base member between each juxtaposed pair of clasps, one of said supporting surfaces underlying said intermediate portion of said tag and supporting said tag in spaced relation to said hook.

11. The combination of claim 10 wherein said base member is in the form of a generally circular ring, and said clasps are defined by inwardly extending, U-shaped gripping elements, spaced about said ring.

12. The combination of claim 11 further including tag-engaging elements extending outwardly from said one supporting surface engaging said tag and limiting movement of said tag relative to said saddle.

13. The combination of claim 12 wherein said tag-engaging elements include a pair of upstanding flanges on opposite sides of said one supporting surface engaging said side edges of said tag and limiting lateral movement of said tag relative to said saddle.

14. The combination of claim 13 wherein each of said flanges includes an upwardly extending leg and an inwardly extending leg spaced from said one supporting surface to define opposed pockets slidingly receiving said side edges of said tag.

15. The combination of claim 12 wherein said intermediate portion of said tag includes a plurality of longitudinally spaced openings, said tag-engaging elements including at least one upstanding projection on said supporting surface engaged in selected openings in said tag to thereby limit longitudinal movement of said tag relative to said saddle.

16. The combination of claim 12 wherein said intermediate portion of said tag includes a plurality of longitudinally spaced openings, said tag-engaging elements including a pair of upstanding flanges on opposite sides of said one supporting surface engaging said side edges of said tag to thereby limit lateral movement of said tag relative to said saddle, and at least one upstanding projection on said one supporting surface engaged in selected openings in said tag to thereby limit longitudinal movement of said tag relative to said saddle.

17. The combination of claim 16 wherein each of said flanges includes an upwardly extending leg and an inwardly extending leg spaced from said one supporting surface to define opposed pockets slidingly receiving said side edges of said tag.

18. The combination of claim 17 wherein said one supporting surface is generally convexly curved whereby said intermediate portion of said tag is arcuately flexed to stiffen said tag.

19. The combination of claim 11 wherein said hook includes a single elongated rod projecting substantially horizontally from the support surface, said at least three clasps spaced substantially equally about said ring, one of said clasps being dimensioned to snap over said rod and grippingly engage said rod at a selected position along the length of said rod to thereby limit the portion of said hook available to receive and suspend products to the portion of said rod forwardly of said saddle, said ring being positioned above said rod with the supporting surface between the other two clasps underlying and supporting said tag in spaced relation to said hook.

20. The combination of claim 19 wherein said intermediate portion of said tag includes a plurality of longitudinally spaced openings, a pair of upstanding flanges on opposite sides of said supporting surface engaging said side edges of said tag to thereby limit lateral movement of said tag relative to said saddle, and at least one upstanding projection on said supporting surface engaged in selected openings in said tag to thereby limit longitudinal movement of said tag relative to said saddle.

21. The combination of claim 20 wherein each of said flanges includes an upwardly extending leg and an inwardly extending leg spaced from said supporting surface to define opposed pockets slidingly receiving said side edges of said tag.

22. The combination of claim 21 wherein said supporting surface is generally convexly curved whereby said intermediate portion of said tag is arcuately flexed to stiffen said tag.

23. The combination of claim 11 wherein said hook includes a pair of parallel elongated rods projecting substantially horizontally from the support surface, said saddle comprising three clasps spaced substantially equally about said ring, one of said clasps being dimensioned to snap over one of said rods and grippingly engage said one rod at a selected position along the length of said one rod, and another of said clasps juxtaposed to said one clasp engaging the other of said rods at a comparable position along its length, to thereby limit the portion of said hook available to receive and suspend products to the portions of said rods forwardly of said saddle, the remainder of ring being positioned below said rods with only the supporting surface between said one and said another clasps extending above said rods and underlying and supporting said tag in spaced relation to said hook.

24. The combination of claim 23 wherein said intermediate portion of said tag includes a plurality of longitudinally spaced openings, a pair of upstanding flanges on opposite sides of said supporting surface engaging said side edges of said tag to thereby limit lateral movement of said tag relative to said saddle, and at least one upstanding projection on said supporting surface engaged in selected openings in said tag to thereby limit longitudinal movement of said tag relative to said saddle.

25. The combination of claim 24 wherein each of said flanges includes an upwardly extending leg and an inwardly extending leg spaced from said supporting surface to define opposed pockets slidingly receiving said side edges of said tag.

26. The combination of claim 25 wherein said supporting surface is generally convexly curved whereby said intermediate portion of said tag is arcuately flexed to stiffen said tag.

27. The combination of claim 10 wherein said distal end of said tag extends beyond said distal end of said hook, further including a flange depending from said distal end of said tag spaced forwardly of said distal end of said hook for displaying identification and/or information regarding product suspended on said hook.

* * * * *